US005954239A

United States Patent [19]

Evans et al.

[11] Patent Number: 5,954,239

[45] **Date of Patent: *Sep. 21, 1999**

[54] AEROSOL SPRAY DISPENSER WITH SWINGING DOWNTUBE

[75] Inventors: Robert M. Evans, Clifton; William L. Klima, Stafford, both of Va.; Walter F. Klima, Jr., Travelers Rest, S.C.

[73] Assignee: Evnx Technologies, Inc., Stafford, Va.

[ * ] Notice: This patent is subject to a terminal disclaimer.

[21] Appl. No.: 08/877,838

[22] Filed: Jun. 18, 1997

Related U.S. Application Data

[63] Continuation of application No. 08/237,905, May 4, 1994, Pat. No. 5,797,522, and a continuation-in-part of application No. 07/974,106, Nov. 10, 1992, and a continuation-in-part of application No. 07/978,381, Nov. 18, 1992, abandoned, and a continuation-in-part of application No. 07/987,147, Dec. 8, 1992, and a continuation-in-part of application No. 08/001,763, Jan. 7, 1993, Pat. No. 5,381,961.

[51] Int. Cl.[6] ..... B67D 5/00

[52] U.S. Cl. ..... 222/464.4; 222/464.3; 239/342

[58] Field of Search ..... 222/464.1, 464.2, 222/464.3; 239/337, 333, 342

[56] References Cited

U.S. PATENT DOCUMENTS

| | | | |
|---|---|---|---|
| 1,665,512 | 4/1928 | Thomas | 239/373 X |
| 1,976,799 | 10/1934 | Nelson . | |
| 2,569,975 | 10/1951 | Cone | 222/464.3 X |
| 2,976,897 | 3/1961 | Beckworth | 239/373 |
| 3,260,421 | 7/1966 | Rabussier | 222/464.2 X |
| 3,301,438 | 1/1967 | Tillotson | 239/464 X |
| 4,418,846 | 12/1983 | Pong et al. | 222/464.2 X |
| 4,530,450 | 7/1985 | Nandagiri | 222/464.2 X |
| 4,830,235 | 5/1989 | Miller | 222/464.3 X |

FOREIGN PATENT DOCUMENTS

| | | | |
|---|---|---|---|
| 63-317484 | 12/1988 | Japan | 222/464 |

*Primary Examiner*—Lesley D. Morris
*Attorney, Agent, or Firm*—Klima & Pezzlo, P.C.

[57] ABSTRACT

An aerosol dispenser having a swinging downtube. Further, the aerosol dispenser is preferably provided with a concave bottom when viewing the bottom from inside the container.

7 Claims, 2 Drawing Sheets

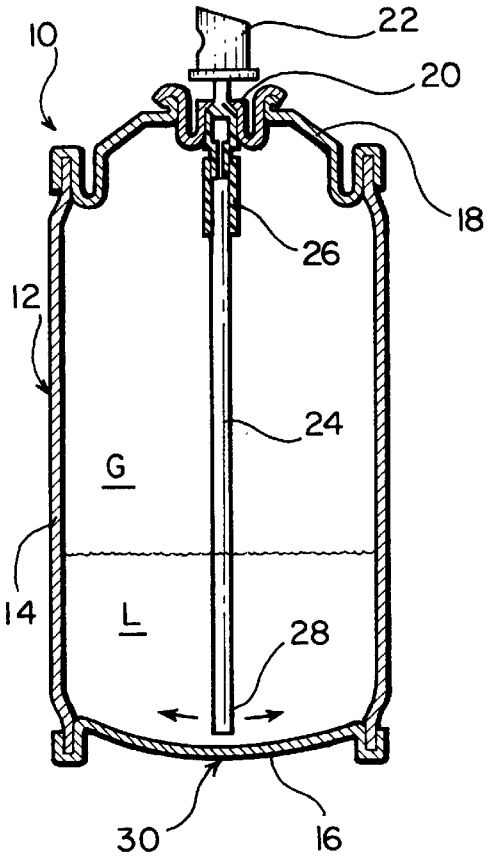
FIG. 1
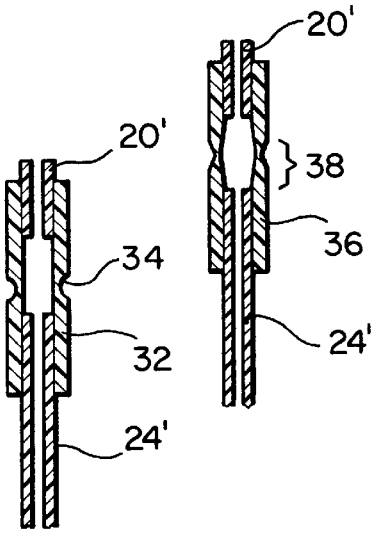
FIG. 2
FIG. 3
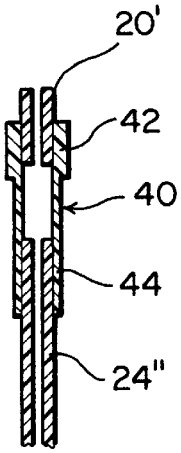
FIG. 4
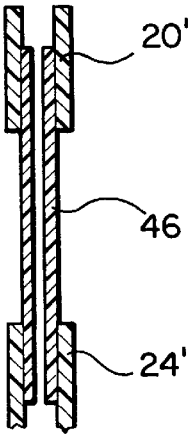
FIG. 5
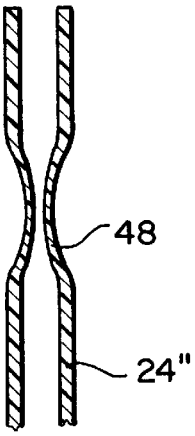
FIG. 6
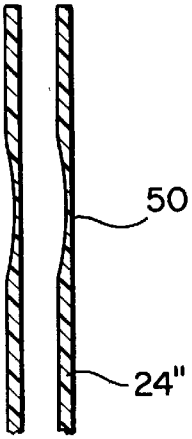
FIG. 7
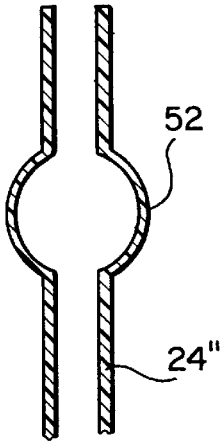
FIG. 8

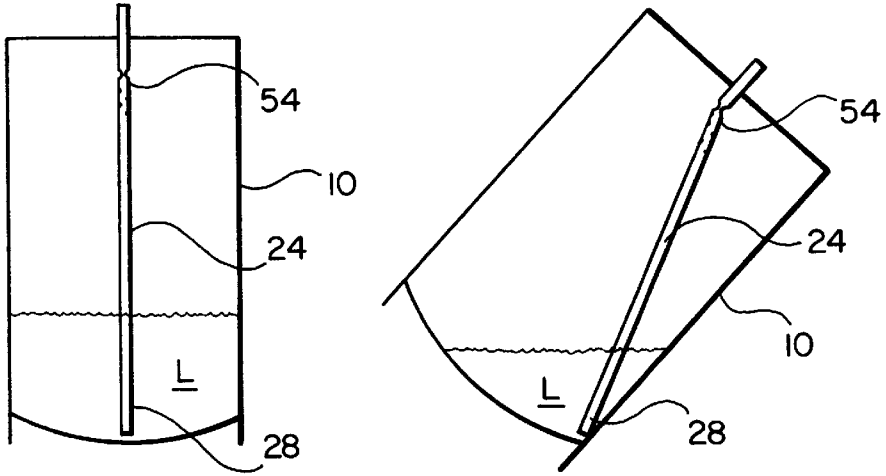
FIG. 9
FIG. 10
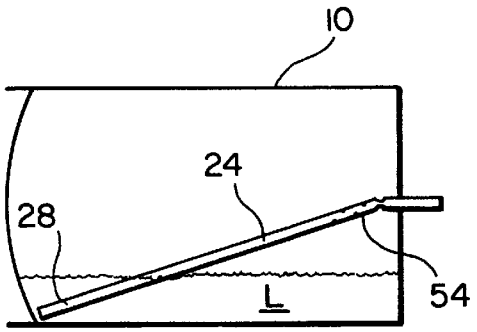
FIG. 11
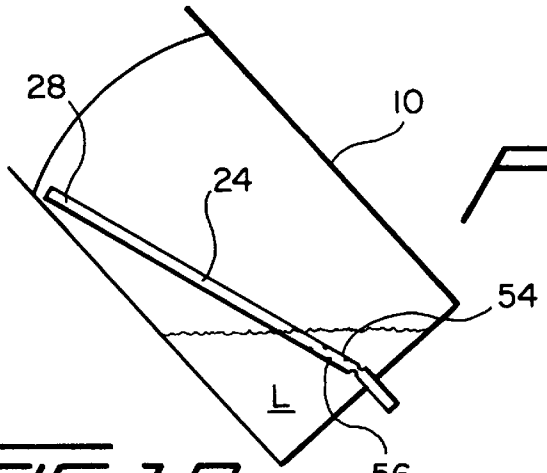
FIG. 12
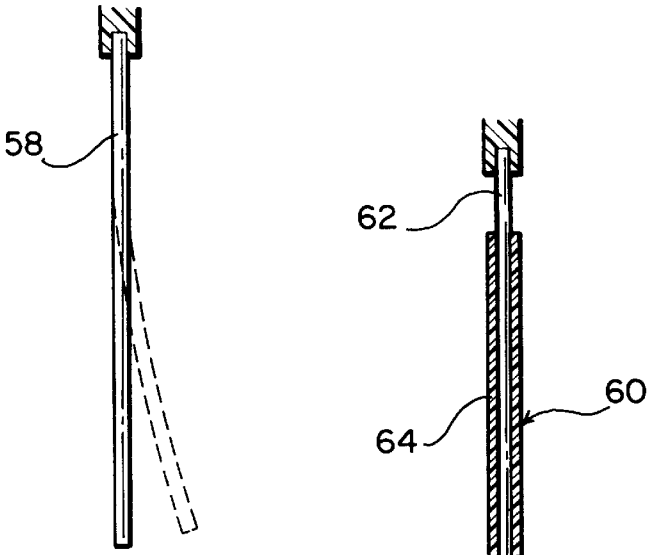
FIG. 13
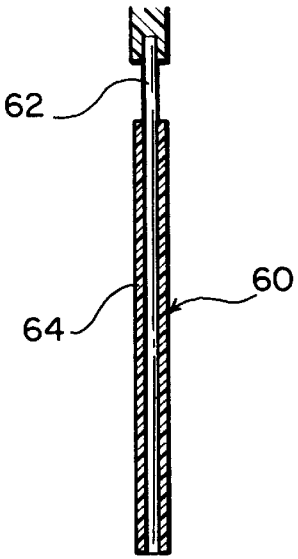
FIG. 14

AEROSOL SPRAY DISPENSER WITH SWINGING DOWNTUBE

RELATED APPLICATIONS

This is a continuation of U.S. Patent Application entitled "Aerosol Spray Dispenser", Ser. No. 08/237,905, filed May 4, 1994, now U.S. Pat. No. 5,797,522, and a continuation-in-part of:

1) U.S. Patent Application entitled "Sprayer With Swiveling Spray Head", Ser. No. 07/974,106 filed on Nov. 10, 1992;

2) U.S. Patent Application entitled "Liquid Dispenser Having Flexible Pickup, Ser. No. 07/978,381 filed on Nov. 18, 1992 and now abandoned;

3) U.S. patent application Ser. No. 07/987,147 filed on Dec. 8, 1992; and

4) U.S. Patent Application entitled "Liquid Pickup For Liquid Dispenser, Ser. No. 08/001,763 filed Jan. 7, 1993, now U.S. Pat. No. 5,381,961, all incorporated by reference herein.

FIELD OF THE INVENTION

This invention relates to an aerosol spray dispenser for dispensing fluids, in particular aerosol spray cans for dispensing liquids. Further, the present invention is directed to aerosol spray container configurations and constructions, in particular to the configuration and construction of the lower portion or bottom of aerosol spray dispensers.

BACKGROUND OF THE INVENTION

In the past decade, the manufacture and use of aerosol cans in the United States has decreased in favor of spray bottle type dispensers. This trend has developed for a variety of reasons, including:

i) eliminate the release of gas or liquid propellants, in particular hydrocarbon propellant such as propane and butane;

ii) eliminate the cost associated in charging an aerosol can with a gas or liquid propellant;

iii) eliminate misuse of aerosol products by consumers (e.g. lighting aerosols on fire, sniffing propellants);

iv) eliminate the every increasing significant risk to manufacturers and bottlers of aerosol from resulting misuse;

v) eliminate aerosols that contain a significant amount of hydrocarbons, which can act essentially as bombs; and vi) eliminate the large disposal of chemical propellants left in aerosols when discarded by consumers when the aerosol is essentially empty of liquid.

This partial list of significant factors for eliminating aerosols would make one wonder why aerosols have not been completely eliminated at this point in time. The reason for the existence of aerosols today is the significant cost savings to bottlers, since aerosols cost a fraction of the cost as the same size spray pump dispenser. Thus, a bottler can sell the same amount of product for significantly less cost and receive the same or greater selling price to the consumer verses product sold in spray pump dispensers.

There exists a tremendous economic advantage to bottlers to continue using aerosol, especially if the above problems can be overcome and eliminated by an improvement in technology.

Aerosols are currently significantly overfilled with propellant, in particular liquid hydrocarbon propellant to ensure the product is fully dispensed from the can prior to the propellant running out. The amount of overfilling percentage wise must be increased if the aerosol is use in such a manner that at some orientations of the aerosol, a significant amount of propellant is released instead of product. Specifically, when an aerosol is highly tilted with a low product level, excessive propellant can be released. With oriented type downtubes, this problem can be significant even with higher products level if it so happens that the aerosol is oriented with the pickup end of the downtube out of the product.

It is highly desirable if an aerosol can be developed that eliminates this effect based on the orientation of the aerosol so that little or no excessive propellant is released during the life cycle of the aerosol. If this can be achieved, then significantly less overfilling of propellent is required in order to ensure substantially complete evacuation of product from the aerosol. Such an improved aerosol would leave less propellant in the aerosol when the product is used up, significantly reducing the amount of chemical propellant currently being disposed in landfills.

Further, misuse of aerosols can be substantially reduced or eliminated by designing or configuring an aerosol that does not allow the release of excessive propellant without product release, no matter what orientation the aerosol is placed. This improvement would save or improve many lives, and significantly reduce the danger associated with current aerosol use. Further, this will greatly decrease the exposure of manufacturers and bottlers to potential liability suits resulting from misuse.

There exists many liquid dispensers having weighted pickup tubes for maintaining the pickup end of the downtube in the liquid being dispensed at various orientation. Typically, the pickup tube (e.g. plastic pickup tubes) are weighted by adding a separate weight to the pickup tube. However, there exist some liquid dispensers that use materials such as metal tubing, which are significantly more dense than the liquid product being dispensed. In these applications, the metal tube acts as a weight even when fully submerge in liquid product due to its significantly greater density than the surrounding liquid (i.e. there is little relative buoyancy).

Conventional aerosols typically use plastic pickup tubes made of, for example, polypropylene and polybutane due to their inexpensive cost. The upper ends of the pickup tubes are rigidly connected to the valve body of the aerosol during assembly. Thus, no weight is required since the downtube is fixed in a downward orientation by the valve body, and cannot essentially move at all inside the aerosol. The prior art is void of any teaching of using unweighted plastic downtubes that are flexibly connected to the valve body or other dispensing device. Further, the prior art does not teach a rigid or semirigid downtube that is flexibly connected to the dispensing device so as to swing and extend to a lower portion of the container.

There exist many examples of highly flexible weighted downtubes for use in liquid dispensing for containers. However, highly flexible weighted downtubes are unsuitable for high speed manufacturing of aerosol dispensers, particularly aerosol cans, due to their difficult handling properties, especially those relating to structural instability. Specifically, it is nearly impossible to load an aerosol can with a highly flexible weighted downtube due to the high rotational forces exerted on the highly flexible downtube that tend to cause the weight to move radially outwardly causing significant misalignment with the aerosol can opening during loading. Further, highly flexible weighed downtubes become tangled together during bulk storage and shipping, making loading onto automatic equipment difficult or impossible.

Containers having a variety of different bottom configurations are used for consumer and industrial products. In particular, aerosol containers ("cans") produced in the billions in the United States have convex shaped bottom configurations when viewing the bottom from inside the can. This type of configuration can sustain substantial pressures up to and exceeding 160 pounds-per-squareinch ("psi") while providing a bottom that allows the can to stand upright on a horizontal flat surface such as counter top or table. Specifically, a conventional aerosol can is constructed of a metal cylinder having a top and bottom portion.

A conventional aerosol can having sheet metal construction (e.g. steel) includes a cylindrical body made by bending sheet metal into a cylinder and butt welding the vertical ends together to form a vertical welded seam; a stamped sheet metal top having a concave configuration when viewing the top from inside the can; and a stamped sheet metal bottom having a convex configuration when viewing the bottom from inside the can. The perimeter of the stamped sheet metal top and bottom are attached to the top perimeter and bottom perimeter, respectively, of the sheet metal cylindrical body. Specifically, the perimeter edge of the stamped sheet metal top and the stamped sheet metal bottom are configured to provide a peripheral receiving groove for receiving the top and bottom perimeter edge, respectively, of the sheet metal cylindrical body. The perimeter edge of the stamped sheet metal top and the stamped sheet metal bottom are crimped over the respective perimeter edges of the sheet cylindrical body to form hermetically sealed perimeter connections between the stamped sheet metal top and bottom and the sheet metal cylindrical body.

The conventional aerosol can includes a valve unit made of stamped sheet metal in combination with additional components for providing the functioning of the valve. A substantially rigid downtube is connected to the valve body, and extends to a perimeter position at the bottom of the can. The conventional convex shape of the can provides a perimeter well or drain in which the pickup end of the downtube is placed.

From 1989 to 1992 many patents were applied for and issued concerning gas aerosol, pressurized dispensers. The primary focus of these inventions and the ultimate reason for them were at least two-fold.

1. The current use of liquified gas propellant i.e. propane, butane, pentane, etc. have been found to pollute the atmosphere and are known as VOC's. These products also are under the right conditions explosive, and extremely flammable. With the current propellants used there is also a very high amount of VOC release during the filling and pressurization phase of production. California and New York have already begun restricting the VOC content on products and the current environmental move is to clearly remove or highly regulate VOC's within the decade "1990's". VOC's will soon be joining CFC's as hazardous, undesirable and dangerous products. Some have even been referred to as carcinogenic. Now, as previously mentioned factory VOC output is of immediate concern, but so is household pollution. With the tighter more efficient, less ventilated new buildings and homes—VOC concentrations are becoming extremely important as they tend to collect and create much worse health risks within our workplaces, home, etc. With the full negative impact of concentrated exposure still unclear, the majority of atmospheric experts are warning as more unfavorable data appears disastrous repercussions for all persons, along with the environment as a whole.

2. The price of the current liquid propellants is more expensive than gas propellants, per unit.

As stated, the industry has for years searched for a suitable solution, during this period the aerosol market has begun to shrink being replaced by trigger pump sprayers, etc. Since the downturn in aerosol production two primary units have emerged as possible replacements.

1. A separate balloon or bag was added into the aerosol containers which would contain the product. This idea allowed for the aerosol unit to be operated from any altitude or angle during the entire spraying process, ensuring that the product would always expel and that the gas propellant would be used efficiently i.e., never expel simply gas. These containers have been in use to expel many food products. They effectively keep products separated like cheese, etc. An attempt to convert these food expelling aerosols to operate as a replacement for conventional aerosols have left a lot to be desired. U.S. Pat. No. 5,211,316 (Adalberto et al) is a good demonstration of this idea in the prior art. Problems concerning these bag "aerosols" are product compatibility with the bag, a constant flow (i.e. consistent amount) of product, production in speed, bag breakage, and spray dispersion (low pressure). As is demonstrated in the Adalberto et al. patent, the aerosol package is complicated which increases the possibility that complications are more likely which could result in minute defects which could result in product failure of a tremendous magnitude involving millions of units. Because these defects may easily be overlooked at the factory, product failure could well happen during the worst possible circumstances. In short, the more integral parts functioning in these designs the more chances of unacceptably high number of failures will elude quality inspections at the factories. If a reliable inspection process could be initiated to increase the possibilities of mistake detection the cost would be prohibited, and as stated previously the cost is already too high except for those limited uses where-it is being employed.

2. An aerosol which utilizes a gas propellant and maintains the basic parts with a "vapor tap" system or "control device" which regulates the gas to liquid ratio that will best utilize the pressure changes associated with gas propellants. The problem with gas charged aerosols is that while the product level drops so does the gas P.S.I. the normal head space P.S.I. for a liquid gas propellant was between 35–55 P.S.I. The pressure is automatically maintained because once some of the head pressure is used the liquified gas would turn to gas and replace it. U.S. Pat. No. 5,125,546 (Dunne et al.) discloses one of each of the gas aerosol products, bag & pressure regulation. U.S. Pat. No. 5,143,288 (Kohler et al.) shows the benefits of using vapor tap holes to regulate pressure which left "enough" pressure left over to cover misuse so the can contents would be certain to empty. The amount was 4015 P.S.I. U.S. Pat. No. 4,940,171 (Gilroy) discloses small vapor tap holes in the valve body which would regulate the gas even more efficiently, resulting in impressive aerosol spraying with lower initial pressure.

A few gas aerosol inventions employed "gas revisions" to maintain a constant pressure. As an idea, too much cost and complicity dooms this concept (see U.S. Pat. No. 4,995,533 to Vanoninck). So to summarize the current aerosol packaging market problem, the use of environmentally safe gases is desired in such a way that the aerosol spray characteristics do not suffer and the production price, dependability of product are maintained in or near the current industry standards. The impact of our invention on these desired characteristics will become evident.

As previously noted the most promising aerosol package (#2) involves environmentally friendly gases in a current aerosol package employing a "vapor tap(s) means to control and enhance spraying characteristics. "Vapor tap" technology is well known such as a valve disclosed in U.S. Pat. No. 3,575,320 issued Apr. 20, 1971 to Jimmie Mason. The problems associated with these "vapor tap" inventions are not identified but are clear to any person familiar in the art. Test conducted by different inventors confirm the viability, reliability of such devices.

The problem which our invention solves in a very inexpensive way is referred to in the industry as "misuse". Misuse is when the aerosol being used is inappropriately tilted which allows propellant gas to escape without the product. This occurs when the can is tilted in such a way that leaves the product entry point exposed to only gas, when the valve is opened gas escapes which is not replenishable, as when liquified gases were employed. The amount of gas released is affected by the gas pressure. Test show that a ten second spray of an aqueous solution containing a head space gas pressure of 95 PSI the pressure will drop to approximately 87 PSI with a release of approximately 2.0 grams per second of product. The same test performed when only gas is released for only five seconds demonstrated a pressure drop to 55 PSI or a loss of 40/SS within half the time. The amount of gas released during misuse was varied with the same product contained, 90% of a 16% contained produce slightly less amounts as the head pressure was reduced, at 55 PSI, five seconds of gas release dropped the pressure to 20 PSI, beginning pressure of 40 PSI was reduced after the gas release 15 PSI, etc. The tests were also conducted where less product was available all these tests met with similar greatly reduced head pressure. Therefore, the possible loss of gas pressure from simple misuse would ultimately leave the leftover gas insufficient to not only empty the container but a substantial amount. The industry has experimented with all types of flexible downtubes, but have found all unacceptable. The industry does, however, have a dispensing valve which will prevent gas loss from the inventors position. Our invention is industry friendly and eliminated the unwanted loss of gas. These properties are shown in the diagrams. It is our invention's intention to produce a cost efficient, simple industrial modification which shall be incorporated into a single reliable and workable aerosol.

SUMMARY OF THE INVENTION

An object of the present invention is to provide an improved aerosol dispenser.

Another object of the present invention is to provide an improved aerosol dispenser having a swinging downtube.

A further object of the present invention is to provide an improved aerosol dispenser having a concave can bottom.

BRIEF DESCRIPTION OF THE DRAWINGS

FIG. 1 is a cross-sectional view of a preferred aerosol can dispenser according to the present invention having a swinging downtube.

FIG. 2 is a detailed cross-sectional view of a preferred flexible connector according to the present invention.

FIG. 3 is another preferred connector according to the present invention.

FIG. 4 is a further preferred flexible connector according to the present invention.

FIG. 5 is a preferred connector according to the present invention having a "tube-inside-tube" construction.

FIG. 6 is a cutaway portion of a one-piece downtube having a flexible joint defined by a contracted portion having reduced wall thickness.

FIG. 7 is another preferred embodiment of one-piece downtube having a flexible joint with a continuous diameter with other portions of the downtube, however, having wall portions of reduced thickness to provide flexibility.

FIG. 8 is a further preferred embodiment of a one-piece downtube according to the present invention having a flexible joint with an increased diameter relative to the remaining portions of the downtube with reduced wall thickness to provide flexibility.

FIGS. 9–12 show various orientations of an aerosol dispenser according to the present invention revealing the pickup end or connector end, either of which can pickup fluid emersed in the liquid contents of the container no matter what orientation.

FIG. 13 is another preferred embodiment of the downtube according to the present invention made of a synthetic polymer, which is initially rigid during insertion into the aerosol dispenser, however, softens due to contact with one or more chemicals so as to become significantly flexible to allow the pickup end of the downtube to swing inside the container.

FIG. 14 is another preferred embodiment of the down tube according to the present invention constructed by coating a flexible tube with a rigid or semi-rigid outer coating providing a flexible joint at an upper portion thereof.

DETAILED DESCRIPTION OF PREFERRED EMBODIMENTS

Definitions: The term "aerosol dispenser" referred to herein is defined by a dispenser for dispensing a fluid (e.g. gas, liquid, emulsion, gas/liquid mixture and other materials having fluid like properties such as powders, and mixtures thereof), and containing a propellant (e.g. gas and/or liquid converting to gas). A typical aerosol dispenser includes a container, a selective release valve, typically actuated by finger manipulation, a downtube extending from the selective valve, product contents, and a propellant. The term "aerosol dispenser" is particularly directed towards aerosol canned type spray dispensers having a fabricated sheet metal can having a concave shaped can bottom and a convex shaped can top, a valve unit connected to the can top, a finger actuated nozzle connected to the valve unit that is actuated by pressing down on the top of the nozzle, a downtube extending from the valve unit to a parameter position where the can bottom is joined with the cylindrical side wall of the can, product contents, and a propellant.

An aerosol can 10 according to the present invention is shown in FIG. 1. The aerosol can includes a can container 12 comprising a cylindrical body portion 14, a concave shaped can bottom 16 when viewing the bottom from inside the can, a concave shaped can top 18, a valve unit 20, a finger actuated nozzle 22, and a downtube 24 connected to the valve unit 20 by a flexible connector 26 to allow the downtube 24 to swing so that the pickup end 28 moves in close proximity to the concave shaped can bottom 16. The aerosol can 10 is charged with various product contents, for example liquid L, and a pressurized gas G acting as a propellant. Alternatively, the gas propellant can be replaced with a liquid that converts to gas during the use and consumption of the gas from the aerosol container, and other combinations of mixtures of product and gas can also be substituted.

The concave shaped can bottom 16 is designed to have a low spot 30 at or near the center thereof to act as drain for liquid when the aerosol can 10 is in a vertical orientation. Thus, even with a rigid or semi-rigid downtube that is not flexibly connected to the valve unit 20, but instead is rigidly connected to the valve unit 20, this provides a configuration that substantially evacuates the contents of the aerosol dispenser. In the preferred embodiment, the pickup end 28 of the downtube 24 moves in close proximity to the concave shaped can bottom 16 at various tilted orientations of the aerosol can. Thus, the pickup end 28 is substantially maintained, in the fluid throughout the operational life of the product.

The aerosol dispensers according to the present invention include swinging downtubes. The swinging downtubes can be constructed to have multiple piece constructions or single-piece constructions.

A variety of multiple piece construction down tubes are shown in FIGS. 1–5.

FIG. 1, a flexible connector 26 is shown. The flexible connector 26 has a continuous thickness wall, as is made from a plastic or other synthetic polymer, and/or rubber type products. The material for making the flexible connector must be selected to withstand the operating conditions within the aerosol container, particularly the chemical resistivity of the product contained therein. Further, the flexible connector must remain sufficiently flexible throughout its life to insure proper swinging operation of the downtube.

In FIG. 2, a flexible connector 32 is shown having a peripheral groove 34, which reduces the thickness at that location of the tube, and provides additional flexibility. In FIG. 3, a flexible connector 36 is shown having a zone 38 of thinner wall thickness to enhance the flexibility of this connector. In FIG. 4, a flexible connector 40 is shown having a thicker portion 42 and a thinner portion 44 providing additional flexibility. In FIG. 5, a flexible joint hereinafter referred to as a "tube-within-a-tube" construction is shown. Specifically, a substantially flexible tube 46 having an outer diameter approximately equal to the inner diameter of the pickup tube 24' and attachment portion of the valve unit 20' flexibly connects the downtube 24' to the valve unit 20'. The ends of the tube 46 can be interference fit, adhered, and/or mechanically fastened in some manner inside the downtube 24' and valve unit 20'. For example, heated pins can be pressed into the downtube 24' and valve unit 20' to provide mechanical fasteners.

A variety of single piece construction type downtubes are shown in FIGS. 6–8.

In FIG. 6, a single piece downtube 24" is shown having a flexible joint 48 defined by a constriction having thinner wall thickness. In FIG. 7, another one piece downtube 24" is shown having a flexible joint 50 having a uniform interdiameter with the downtube, however, having thinner wall thickness at the joint. The embodiments shown in FIGS. 6 and 7 can be made by locally stretching the downtube to thin the wall thickness to provide a flexible joint. In FIG. 8, a downtube 24" is shown having a flexible joint 52 defined as an expanded portion having thinner wall thickness to provide flexibility. This embodiment can be formed by locally heating the tube and pressurizing the inside of the tube to cause the expanded portion.

The operation of an aerosol dispenser according to the present invention as shown in FIGS. 9–12.

In FIG. 9, the aerosol can 10 is in a vertical orientation. The pickup end 28 of the downtube 24 is clearly emersed in the Liquid. Even with very low liquid levels, the pickup end 28 will still remain substantially emersed in the liquid.

In FIG. 10, the aerosol can 10 is shown at approximately a 45 degree angle. The pickup end 28 of the downtube 24 swings to the lowest position in the aerosol can 10. Even with very low liquid levels in this orientation, the pickup end 28 will remain emersed in the liquid.

In FIG. 11, the aerosol can 10 is at approximately a 90 degree orientation with the pickup end 28 positioned at a lowest position inside the aerosol can 10 thus, even with very low liquid levels the pickup end 28 will remain in the liquid.

In FIG. 12, the aerosol can 10 is at an orientation of approximately 135 degrees with the pickup end 28 extending out of the fluid. In this particular embodiment, the connector end 54 is provided with an alternative means for picking up fluid such as a ballcheck valve and/or very small holes 56 in the connector end 54 of the pickup tube 24. Alternative bodies of swinging downtubes according to the present invention are shown in FIGS. 13 and 14. In FIG. 13, a downtube 58 is shown that is initially rigid or semi-rigid prior to being loaded into the aerosol can. Once inside the aerosol can, the downtube 58 chemically reacts with the liquid product so as to soften and become somewhat flexible. However, the tube remains still sufficiently flexible with sufficient structural stability so as not to fold onto itself when the aerosol can is in an upside down position. Thus, the pickup end is held at or near the bottom of the aerosol can.

In FIG. 14, a downtube 60 is shown constructed of a flexible tube 62 having a rigid or semi-rigid coating 64 provided thereon. The coating 64 can be applied by a dipping process and/or spray material onto the flexible tube 62.

We claim:

1. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by a flexible tubing connector having a peripheral groove reducing a thickness of said flexible tubing connector to enhance the flexibility of said flexible connector.

2. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by a flexible tubing connector having a zone of thinner wall thickness to enhance the flexibility of said flexible tubing connector.

3. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by a flexible tubing connector having a portion with a thicker wall thickness and another portion with a thinner wall thickness to enhance the flexibility of said flexible tubing connector.

4. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by a flexible tubing connector defined by a section of tubing having an outer diameter approximately equal to an inner diameter of said downtube.

5. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by connecting an upper end portion of said downtube to said dispensing unit, and providing said downtube with a constriction having thinner wall thickness between said upper end portion and a main portion of said downtube.

6. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by connecting an upper end portion of said downtube to said dispensing unit, and providing said downtube with a connection portion having thinner wall thickness between said upper end portion and a main portion of said downtube.

7. An aerosol spray dispensing apparatus for dispensing a fluid, said apparatus comprising:

a pressurized container for storing fluid contents;

a dispensing unit connected to said container, said dispensing unit including a dispensing valve for selectively dispensing fluid contents to be stored inside said container, said dispensing valve configured for selectively releasing fluid from said container when actuated by a user and sealing fluid contents inside said container when non-actuated; and a substantially rigid plastic downtube flexibly connected to said dispensing unit to allow said plastic downtube to substantially swing freely inside said container, said downtube having a sufficient length to extend from said dispensing unit to a position in close proximity to a bottom of said container; wherein said downtube is flexibly connected to said dispensing unit by connecting an upper end portion of said downtube to said dispensing unit, and providing said downtube with an expanded portion having a thinner wall thickness between said upper end portion and a main portion of said downtube.

* * * * *